US009650823B2

(12) United States Patent
Svenson

(10) Patent No.: US 9,650,823 B2
(45) Date of Patent: May 16, 2017

(54) POST FOR TWO SECTION FOLDING CLOSURE AND FOLDING CLOSURE USING SAME

(71) Applicant: Julian Michael Svenson, Cornwall (CA)

(72) Inventor: Julian Michael Svenson, Cornwall (CA)

(73) Assignee: Dynamic Closures Corporation, Long Sault, Ontario (CA)

( * ) Notice: Subject to any disclaimer, the term of this patent is extended or adjusted under 35 U.S.C. 154(b) by 77 days.

(21) Appl. No.: 14/544,831

(22) Filed: Feb. 24, 2015

(65) Prior Publication Data

US 2016/0168889 A1 Jun. 16, 2016

(30) Foreign Application Priority Data

Dec. 11, 2014 (CA) ..... 2874347

(51) Int. Cl.

| | |
|---|---|
| ***E06B 3/32*** | (2006.01) |
| ***E05D 15/06*** | (2006.01) |
| ***E05B 65/00*** | (2006.01) |
| ***E05B 65/08*** | (2006.01) |
| ***E06B 3/36*** | (2006.01) |
| ***E06B 3/48*** | (2006.01) |

(52) U.S. Cl.

CPC ..... *E05D 15/0652* (2013.01); *E05B 65/0085* (2013.01); *E05B 65/0811* (2013.01); *E06B 3/365* (2013.01); *E06B 3/481* (2013.01)

(58) Field of Classification Search

CPC . E06B 3/94; E06B 3/365; E06B 3/481; E06B 3/487; E05B 65/00835; E05B 65/0847; E05B 65/0085

USPC ..... 160/117, 119, 84.01–84.11, 341, 118, 160/199, 196.1, 201, 206

See application file for complete search history.

(56) References Cited

U.S. PATENT DOCUMENTS 1,524,006 A * 1/1925 Dodge ..... E05C 17/446 16/DIG. 31
2,713,897 A * 7/1955 Teague ..... E05B 1/0015 16/412

(Continued)

FOREIGN PATENT DOCUMENTS

DE 10261157 A1 * 7/2004 ..... E05B 65/0085
DE 102008054199 A1 * 5/2010 ..... E05B 17/2084

(Continued)

*Primary Examiner* — Katherine Mitchell
*Assistant Examiner* — Johnnie A Shablack
(74) *Attorney, Agent, or Firm* — George A. Seaby

(57) ABSTRACT

A female locking post for the free end of a folding closure section, with an inner side for connecting the post to the free end, and an outer side opposite the inner side. Two opposed connecting walls connect the inner and outer sides together. An interior wall, spaced from both the inner and outer sides, extends between the connecting walls. A post opening, preferably extending the length of the post, is provided in the outer side between the connecting walls providing access to the interior wall. An operator with a lock bolt is movably mounted on the interior wall, the operator movable along the interior wall between an unlocked position where the lock bolt is within the post and a locked position where the lock bolt projects from an end of the post. A folding closure incorporating the female post is also described.

7 Claims, 6 Drawing Sheets

(56) References Cited

U.S. PATENT DOCUMENTS 3,082,817 A * 3/1963 Merrill ..... E06B 3/94 160/40
3,156,293 A * 11/1964 Reynolds ..... E06B 7/2309 160/40
3,223,147 A * 12/1965 Holloway ..... E06B 3/94 160/84.09
3,348,628 A * 10/1967 Dixon ..... E06B 3/94 160/40
3,378,290 A * 4/1968 Sekulich ..... E05C 9/04 292/40
3,380,647 A * 4/1968 Harris ..... E05C 5/00 292/110
3,617,080 A * 11/1971 Miller ..... E05C 9/045 292/171
3,649,060 A * 3/1972 Ruff ..... E05C 1/04 292/147
3,670,797 A * 6/1972 Sassano ..... E05D 15/26 160/118
3,774,342 A * 11/1973 Thom ..... E05D 15/066 16/99
3,799,237 A 3/1974 Proserpi
3,850,223 A * 11/1974 Tompkins ..... E06B 3/94 160/235
3,888,046 A * 6/1975 Meisterheim ..... E05B 65/1006 292/21
4,052,819 A * 10/1977 Beischel ..... E06B 3/365 49/368
4,058,332 A * 11/1977 DiFazio ..... E05C 1/04 292/147
4,315,648 A * 2/1982 Labelle ..... E05C 1/04 292/145
4,357,981 A * 11/1982 Labelle ..... E05B 65/0085 160/183
4,377,303 A * 3/1983 McPherson ..... E05B 17/2019 292/152
4,429,493 A * 2/1984 St. Aubin ..... E05C 7/04 49/367
4,475,313 A * 10/1984 Governale ..... E05B 65/0811 292/101
4,658,878 A * 4/1987 Williams ..... E06B 3/94 160/84.09
4,834,161 A * 5/1989 Johnson ..... E05B 65/087 160/118
4,848,436 A 7/1989 Dagenais
4,924,929 A * 5/1990 Johnson ..... E05B 65/087 160/118
4,944,169 A * 7/1990 Labelle ..... E05C 1/04 292/179
5,097,883 A 3/1992 Robinson
5,350,207 A * 9/1994 Sanders ..... E05B 15/0245 292/335
5,755,270 A * 5/1998 Knezevich ..... E05B 65/0085 160/118
5,857,291 A * 1/1999 Headrick ..... E05C 1/04 292/145
6,453,616 B1 * 9/2002 Wright ..... E05C 7/045 49/365
6,457,751 B1 * 10/2002 Hartman ..... E05B 17/2053 292/137
6,637,784 B1 * 10/2003 Hauber ..... E05B 63/242 292/300
6,666,486 B1 * 12/2003 Fleming ..... E05B 17/2069 292/145
6,669,244 B1 12/2003 Bredthauer
6,851,730 B2 * 2/2005 Haab ..... E05B 65/0085 292/103
6,905,152 B1 * 6/2005 Hudson ..... E05C 1/065 292/143
7,140,154 B2 * 11/2006 Governale ..... E05C 1/06 49/366
7,513,539 B2 * 4/2009 Phipps ..... E05B 17/2053 292/143
7,845,384 B2 * 12/2010 Goodman ..... E05B 65/0085 160/118
8,109,315 B2 * 2/2012 Schneider ..... E05D 15/26 160/199
8,522,853 B2 9/2013 Coleman
9,051,763 B2 * 6/2015 Taylor ..... E05C 9/185
9,309,696 B2 * 4/2016 Friese ..... E05B 53/00
9,353,568 B2 * 5/2016 Knight ..... E06B 3/94
9,388,611 B2 * 7/2016 Schuberth ..... E05C 9/047
2003/0052492 A1 * 3/2003 Massey ..... E05C 1/04 292/341.15
2005/0120630 A1 * 6/2005 Sanders ..... E06B 7/215 49/365
2005/0120631 A1 * 6/2005 Sanders ..... E06B 7/215 49/367
2008/0148790 A1 * 6/2008 Friese ..... E05B 53/00 70/101
2008/0157544 A1 * 7/2008 Phipps ..... E05B 17/2053 292/138
2009/0044918 A1 * 2/2009 Goodman ..... E05B 65/0085 160/202
2009/0152879 A1 * 6/2009 Pala ..... E05C 9/046 292/305

FOREIGN PATENT DOCUMENTS

DE 202013103511 U2 * 9/2013 ..... E05C 3/042
EP 2728101 A2 * 5/2014 ..... E06B 5/168
FR 2990461 A1 * 11/2013 ..... E05B 17/2088

* cited by examiner

POST FOR TWO SECTION FOLDING CLOSURE AND FOLDING CLOSURE USING SAME

BACKGROUND OF THE INVENTION

Field of the Invention

This invention relates to a female locking post for use on one section of a two section folding closure. The invention also relates to the two section folding closure using the female locking post on the free end of one of the sections for locking the sections together in a closed position.

Background of the Invention

Two section folding closures are used to close wide openings in buildings with one section mounted on one side of the opening and the second section mounted on the other side of the opening. Using two sections in the closure facilitates installation and handling of the closure and also allows for a smaller storage space for the sections on the sides of the opening. Each section has a locking post at its free end. A first of the locking posts contains a lock bolt for locking one end of a first section to the floor of the building. The other locking post has a lock for locking the second post to the first post. The lock bolt in the first post usually has an external operator for causing it to move. On longer closures, the lock bolt, being operable from outside the post, could be released from the floor and the closure could be swung laterally to raise the bottom of the closure enough to allow entry under the closure. Thus, two section closures are limited in their length so that they can be used in a secure manner. An external operator on the locking post for the lock bolt limits the versatility of the post since the operator should always be located on the inside of the closure, but often cannot be so positioned. An external operator is also vulnerable to damage.

SUMMARY OF THE INVENTION

An object of the present invention is to provide a female locking post having an internal operator for a lock bolt in the post thus making a folding closure using the locking post more secure. Another object of the present invention is to provide an operator for the lock bolt that is centrally mounted in the locking, post to provide more versatility in using the post. It is yet another object of the present invention to provide an operator that is unlikely to be damaged.

In accordance with one aspect, the present invention comprises a female locking post for use on the free end of a first folding closure section of a two section folding closure. The female post has a body including an inner wall, a pair of side walls and an open outer side. The inner wall of the post body contains a channel for connecting the post to the free end of the first folding section. A partition extends between the side walls, and is spaced from both the inner wall and the open outer side. An operator with a lock bolt is mounted in a channel in the partition in a position where it is accessible through the open outer end of the body of the post. The operator is manually movable along the partition in a longitudinal direction between an unlocked position in which the lock bolt is the post body and a locked position in which the bolt projects downwardly from the bottom end of the post.

In accordance with another aspect, the invention comprises a folding closure for closing an opening in a building wall. The folding closure includes first and second folding sections having hardware along the top thereof for suspending the sections from an overhead rail at the top of the opening, each section having one end configured for fastening the section to one side of the opening and a free end. The body of a female locking post is connected to the free end of the first folding section, and a male locking post is connected to the free end of the second folding section. The female post body has an at least partially open outer side facing the male locking post. The female post contains an operator carrying a lock bolt for locking the first folding section to a floor in the building. The operator is operated through the opening in the outer side of the female post. The male locking post is movable into the female locking post to close the opening in the outer side of the female post when joining the sections together to close the building opening. The posts have cooperating locking members for locking the male locking post to the female locking post.

BRIEF DESCRIPTION OF THE DRAWINGS

In order to facilitate illustration of the invention, some of the figures of drawings are on different scales from others. Whenever possible, the same reference numbers have been used to identify the same or slightly different elements in the various figures in the drawings.

DETAILED DESCRIPTION OF THE INVENTION

In the present case, a female locking post is intended to mean a post with a body having a generally C-shaped cross section and an at least partial open outer side. The open outer side extends the length of the post for receiving a male locking post to close the female post opening.

Figure 1:
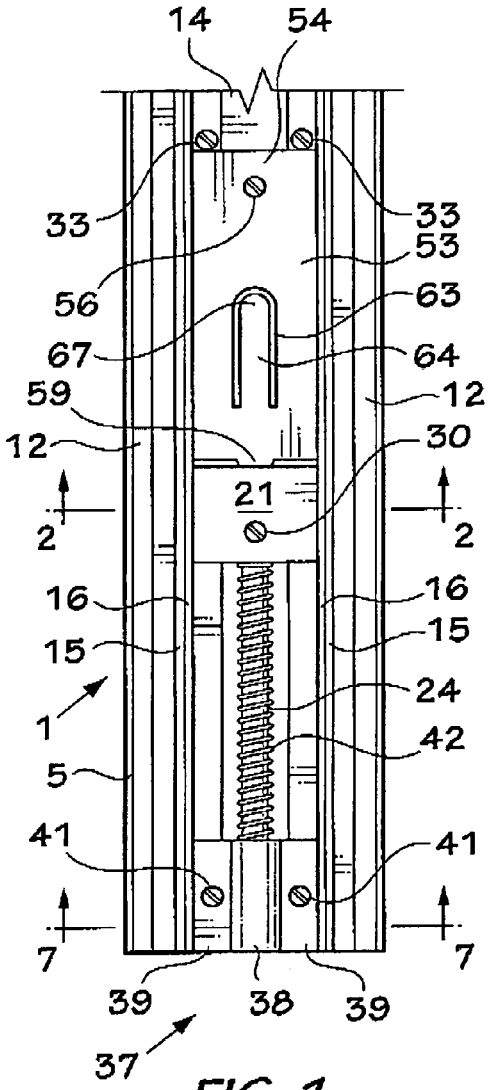
FIG. 1 is a front view of the bottom portion of a preferred embodiment of a female locking post in accordance with the present invention.
Figure 2:
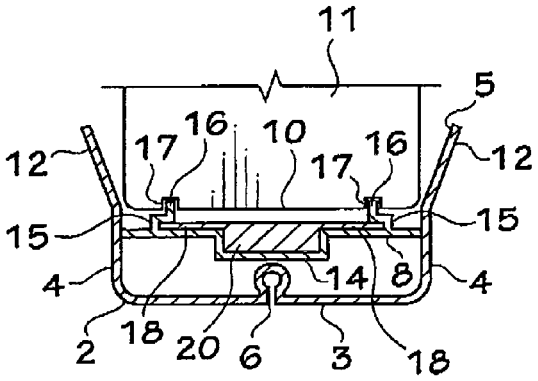
FIG. 2 is a cross section taken generally along line 2-2 of FIG. 1.

Referring to FIGS. 1 and 2, a female locking post indicated generally at 1 in accordance with the present invention includes an elongated body 2 defined by an inner wall 3, side walls 4 and an open outer end 5 spaced apart from and generally parallel to the inner wall 3. A slot 6 extends the length of the inner wall 3 for connecting the post 1 to the outer end of a section of a folding closure in a known manner. A partition 8 extends between the side walls 4. The partition 8 is spaced apart from both the inner wall 3 and the open outer end 5 of the body 2, and extends the length of the post body 2.

The open outer end 5 of the body 1 provides access to the partition 8. As described hereinafter in greater detail, the open end 5 is wide enough to permit passage of the leading end 10 of a male locking post 11 mounted on the free end of a second section of the folding closure into the female post 1 to close the open outer end 5. To facilitate entry of the male post 11 into the body 2, the outer ends 12 of the side walls 4 preferably diverge slightly from each other.

A longitudinally extending channel 14 is provided in the partition 8. The channel 14 has a generally U-shaped cross section and extends inwardly toward the inner wall 3. The channel 14 is open toward the outer end 5. A track 15 extends along the length of the body on each side of the partition 8 between the body side wall 4 and each side of the channel 14. The tracks 15 extend outwardly from the partition 8 toward the open outer end. When the male locking post 11 is in the female post 1, outwardly extending flanges 16 on the tracks 15 mate with longitudinally extending grooves 17 in the male locking post 11 to properly locate the lead end 10 of the post 11 in the body 1. The tracks 15 define opposed channels for receiving laterally extending wings 18 (FIG. 2) and 19 on the outwardly extending upper and lower ends 20 and 21, respectively of a lock operator indicated generally at 22 in FIGS. 3 to 6.

As best shown in FIGS. 3 to 6 and 8 the lock operator 22 includes an elongated body 23 with a bolt 24 extending out of the lower end 21 thereof. The bolt 24 is mounted in a hole 27 (FIG. 8) in the lower end 21 of the body 23. A fastener 30 is threaded through a hole 31 in the lower end 21 (FIG. 8) for securing the bolt 24 in the operator body 23.

Figure 3:
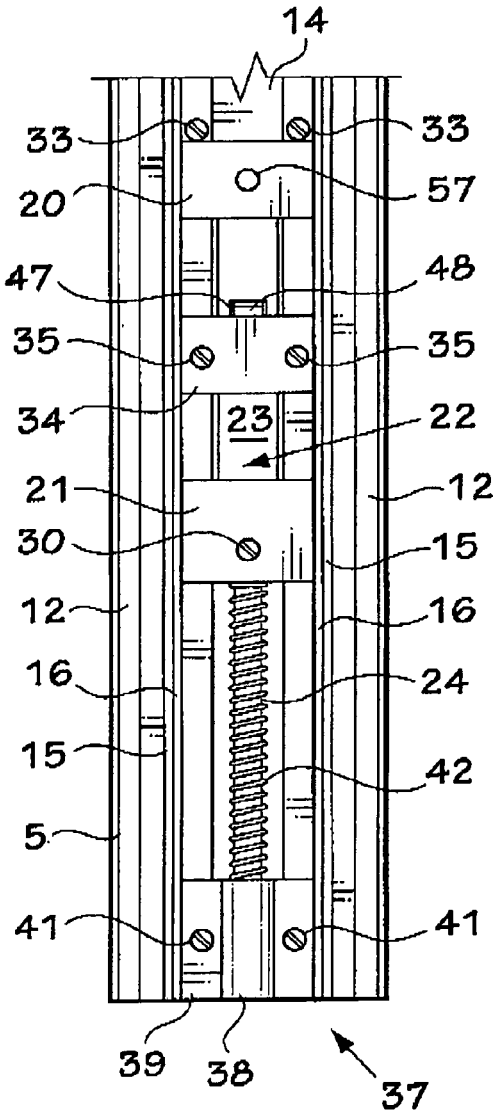
FIG. 3 is a front view of the bottom portion of the post shown in FIG. 1 in an unlocked condition with a part removed.
Figure 4:
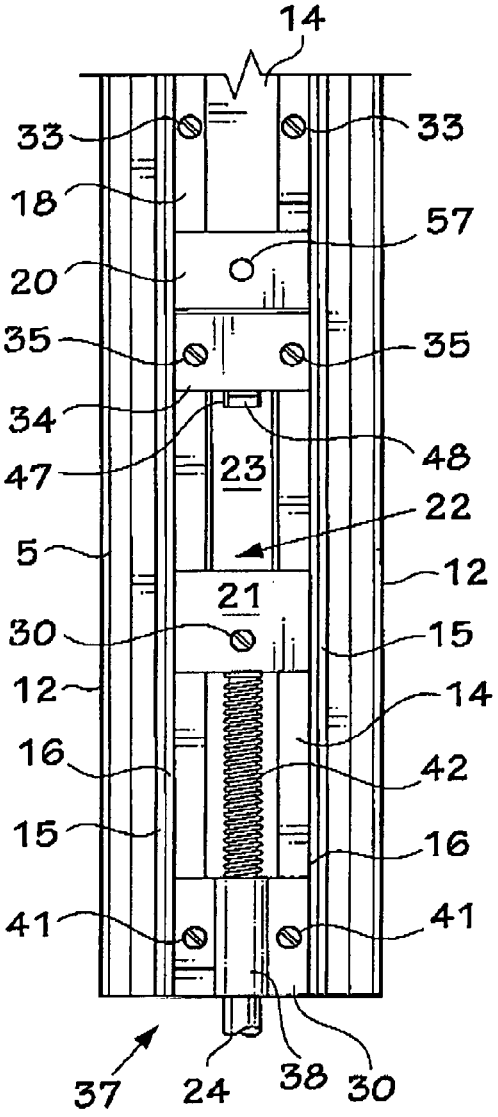
FIG. 4 is a front view of the bottom portion of the post in a locked position with a part removed.
Figure 5:
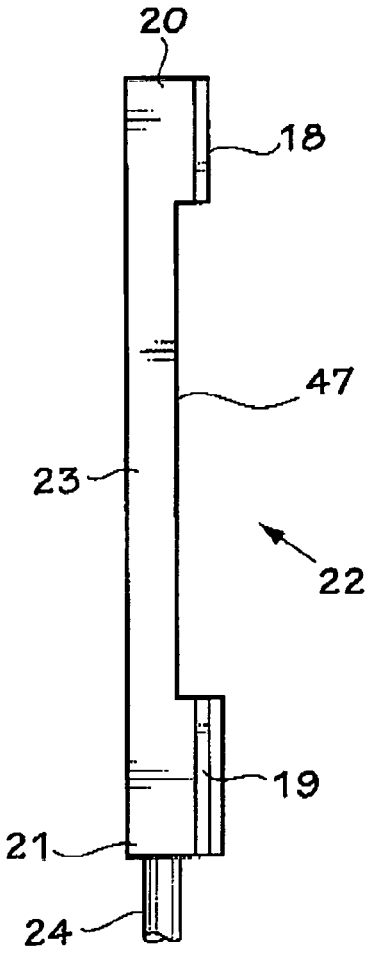
FIG. 5 is a side view of an operator used in the female post of FIGS. 1 to 4.
Figure 6:
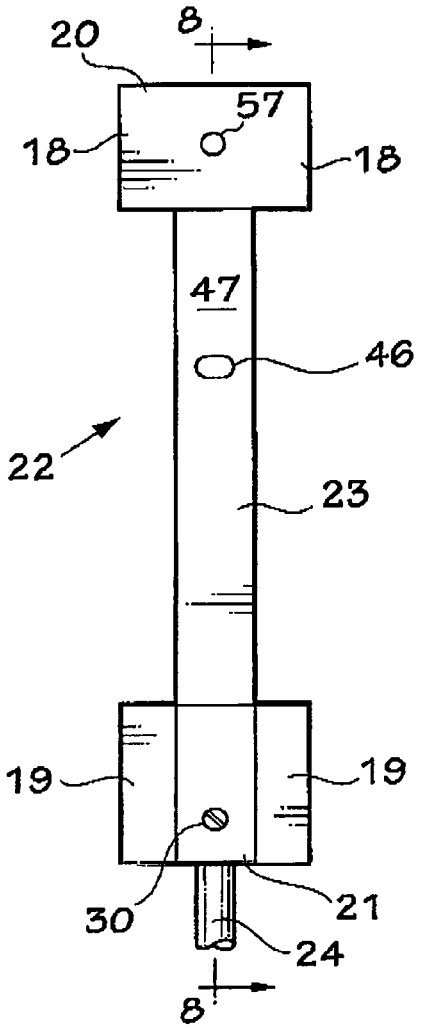
FIG. 6 is a front view of the operator of FIG. 5.

The operator body 23 is rectangular in cross section and fits snugly in the channel 14 in the partition 8 so that the operator can slide longitudinally in the channel 14 between a door unlocked position (FIGS. 1 and 3) and a door locked position (FIG. 4). Upward movement of the body 23 is limited by upper stops defined by a pair of screws 33 (FIGS. 1, 3 and 4) mounted in the partition 8. As mentioned above, the upper and lower ends 20 and 21 of the operator body 23 extend outwardly from the remainder of the body and have laterally extending wings 18 and 19 for sliding in the tracks 15. Downward movement of the operator body 23 in the channel 14 is limited by a stop plate 34 (FIGS. 3 and 4) mounted in the tracks 15 and attached to the partition 14 by screws 35.

Figure 7:
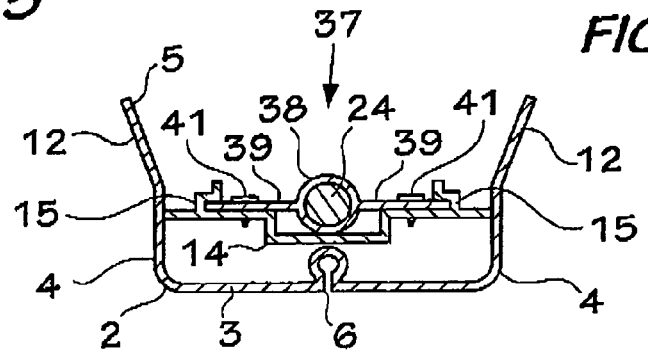
FIG. 7 is a cross section taken generally along line 7-7 of FIG. 1.
Figure 8:
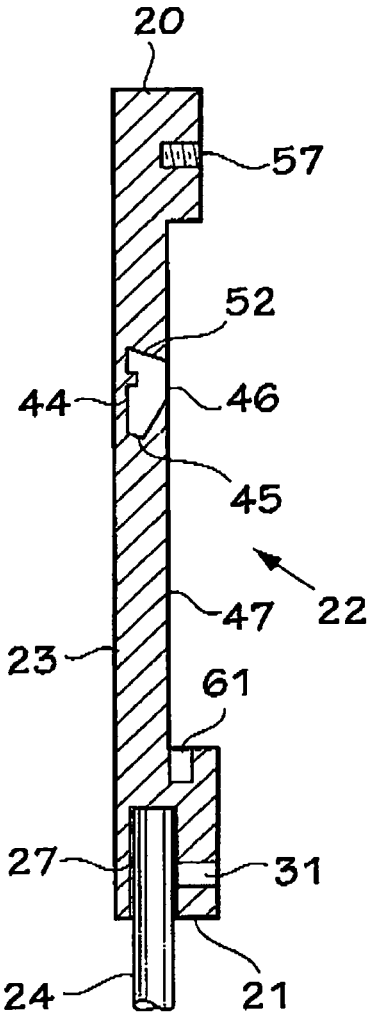
FIG. 8 is a cross section taken generally along line 8-8 of FIG. 5.
Figure 9:
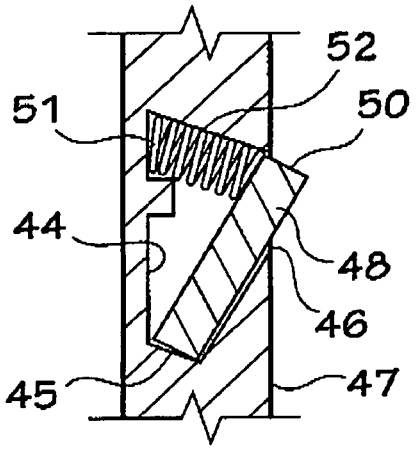
FIG. 9 is a longitudinal sectional view of a portion of the operator showing a lock.
Figure 10:
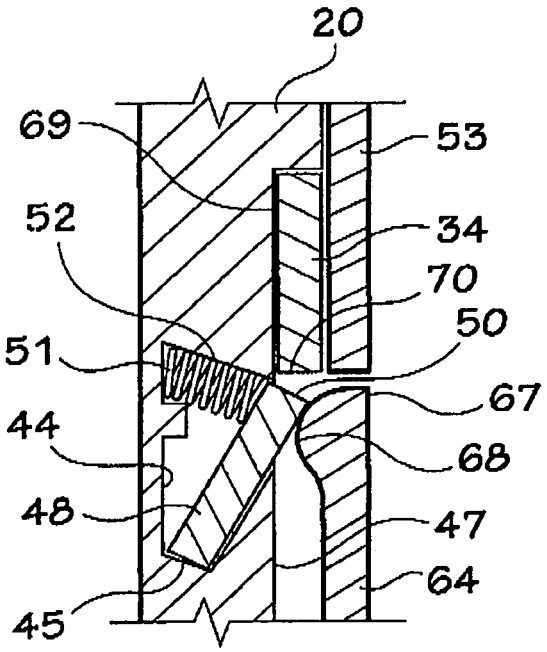
FIG. 10 is a longitudinal sectional view of the operator showing the lock.

Referring to FIGS. 3 and 7, during movement of the operator 22 in the channel 14, the bolt 24 slides in a guide indicated generally at 37 mounted in the bottom end of the channel 14. The bolt guide 37 includes a cylindrical body 38 and wings 39 extending outwardly from opposite sides thereof into the tracks 15. The wings 39 are connected to the partition 8 by screws 41. A helical compression spring 42 is mounted on the bolt 24 above the bolt guide 37. The spring 42 biases the operator body 23 upwardly to the unlocked position shown in FIG. 3.

With reference to FIGS. 1 and 8 to 10, the operator is retained in the locked position shown in FIG. 4 by a lock mechanism, which includes the stop plate 34 and a cavity 44 in the operator body 23. When viewed from the side, the cavity 44 has a generally triangular shape with an outer side and a bottom corner 49 cut off. The cavity 44 has an opening 46 in the outer surface of a recessed section 47 of the operator body 23. A lock bar 48 is pivotally mounted in the cavity 44 for rotation between an extended locking position shown in FIG. 9 in which the outer free end 50 of the bar extends out of the cavity 44 to prevent upward movement of the operator body 23, and a retracted, release position (not shown) in which the outer end 50 of the bar 48 is pressed into the cavity to permit upward movement of the operator body 23. The free end 50 of the bar 48 is biased outwardly to a locked position (FIG. 10) by a helical spring 51 mounted in the generally semi-cylindrical end 52 of the cavity 44.

A cover 53 (FIGS. 1 and 10) in the form of a thin flexible plate is mounted on the operator 22. As shown in FIG. 1, the cover 53 extends between the tops of the upper and lower ends 20 and 21, respectively, of the operator body 23. The upper end 20 of the operator 22 extends outwardly a shorter distance than the bottom end 21. The top end 54 of the cover is mounted on the upper end 20 of the operator and is secured thereto by a screw 56 (FIG. 1) threaded into a hole 57 (FIGS. 3, 4 and 6) in such upper end. A tab 59 on the bottom end 60 is first inserted into a notch 61 (FIG. 8) in the lower end 21 of the operator body 23.

An elongated, inverted U-shaped slot 63 is cut in the cover 53 to define a finger 64, which can be flexed inwardly toward the bar 48. The upper end 67 of the finger 64 has an interior protuberance 68 which can bear against the top, outer end 50 of the bar 48.

In operation, with the operator 22 in the upper position against the screws 33 (FIGS. 1 and 3) and the bolt 24 inside the guide 37, the operator 22 is manually pushed downwardly with the bolt 24. When the operator 22 moves downwardly the outer end 50 of the bar 48 is pushed into the cavity 44 as the bar slides against the inner surface 69 of the stop plate 34. During downward movement of the operator 22, the lock bar 48 remains depressed and slides against the inner surface 69 (FIG. 10) of the stop plate 34 until the bolt 24 is fully extended. Once the top end 50 of the bar 48 passes the bottom end 70 of the stop plate 34, the spring 51 pushes the top end 50 of the bar 48 outwardly beneath the bottom end 70. When the operator is released, the bar 48 bears against the bottom end 70 of the plate 34, preventing upward movement of the operator from the locked position. Thus, the bolt 24 is locked in the extended, locked position (FIG. 4).

In order to unlock the door or closure, the upper end 67 of the finger 64 is depressed so that the protuberance pushes the upper end 50 of the bar 48 into the cavity 44. The spring 42 on the bolt 24 pushes upwardly against the lower end 21 of the operator 22 to return the operator to the unlocked position. During upward movement of the operator 22, the outer end 50 of the bar 48 slides against the inner surface 69 of the stop plate 34. When the operator 22 reaches its uppermost position with the upper end 20 abutting the screws 33, the spring 51 pushes the outer end 50 of the bar 48 out of the cavity opening 46.

Figure 11:
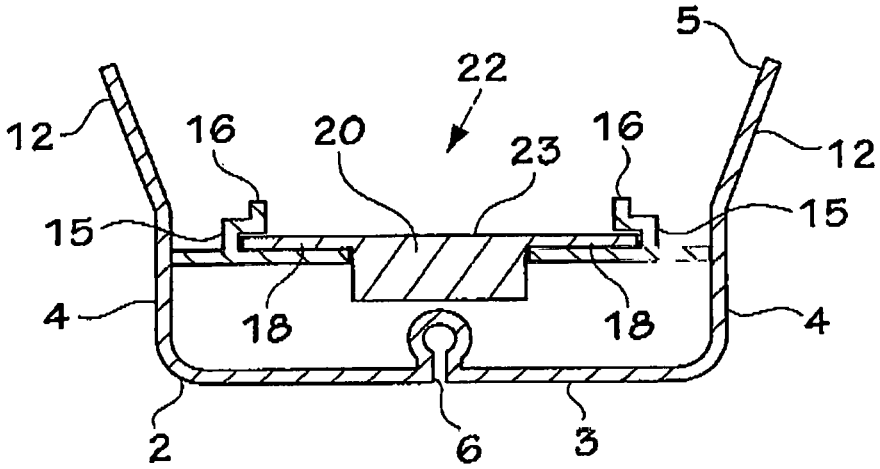
FIG. 11 is a cross-sectional view of a second embodiment of a body used in the female post.

With reference to FIG. 11, in another embodiment of the invention, the channel 14 in the partition 8 is omitted. The body 23 of the operator 22 rides in a slot 70 in the partition 8.

Figure 12:
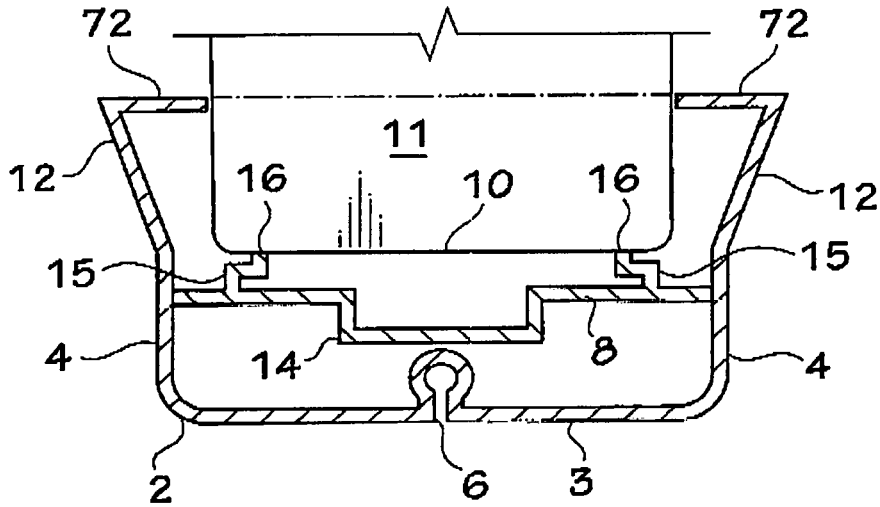
FIG. 12 is a cross-sectional view of a third embodiment of the female post body.

Referring to FIG. 12, in yet another embodiment of the invention for use with a narrower male locking post 11, the outer end of the post body 2 is partially closed by inwardly extending flanges 72 on the outer ends of the side walls 4.

When the narrow male post 11 enters the partially open outer end of the body 2, the post 11 is centered by the flanges 72, and the outer end 10 of the post 11 abuts the inner ends 16 of the tracks 15.

Figure 13:
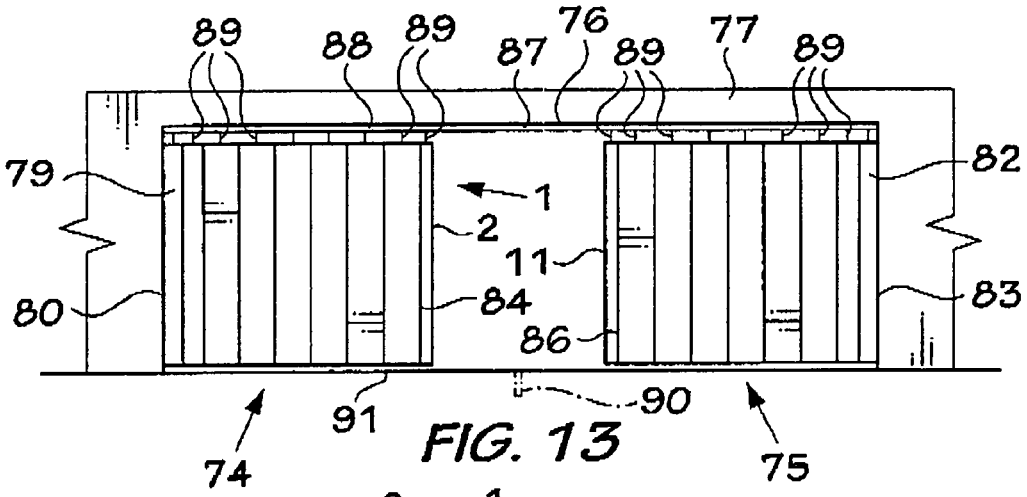
FIG. 13 is a front view of a two section closure incorporating the female post.
Figure 14:
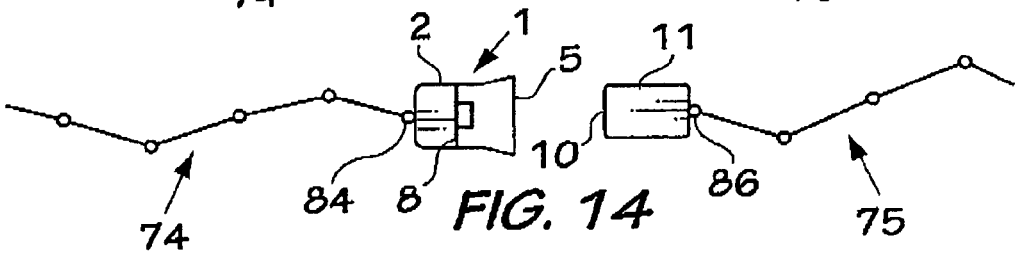
FIG. 14 is a schematic cross section of the free ends of two closure sections immediately before closing.
Figure 15:
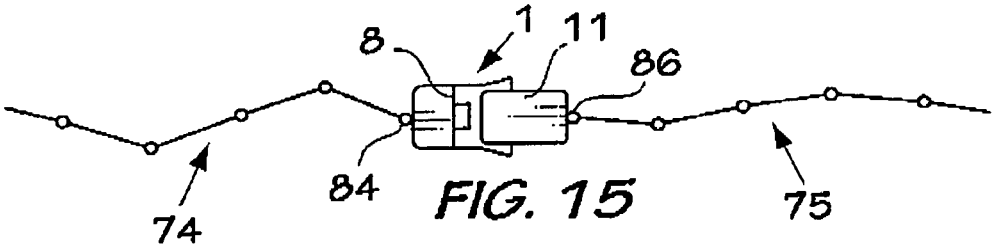
FIG. 15 is a cross section of the closure sections with the free ends joined.

FIGS. 13 to 15 illustrate the use of the female locking post 1 on a folding closure formed of two sections indicated generally at 74 and 75 closing an opening 76 in the wall 77 of a building. One end 79 of a first folding section 74 is connected to one side 80 of the opening 76, and one end 82 of the second folding section 75 is connected to the other side 83 of the opening 76. A female locking post 1 is mounted on the other free end 84 of the folding section 74. The inner wall 3 of the post 1 is mounted on the first section 74 using the slot 6 in the center of the inner wall 3. The open side 5 of the post body 2 faces outwardly away from the section 74. A male locking post 11 is mounted on the free end 86 of the second folding section 75. The folding sections 74 and 75 are suspended from a top rail 87 on the top of the wall opening 76 by trolleys 89 projecting upwardly from the top of sections 74 and 75 in a known manner.

When the wall opening 76 is to be closed, the first folding section 74 is unfolded from the one side 80 of the opening 76 and the post 1 is located such that the bolt 24 is over a hole 90 (FIG. 13) in the floor 91 at the bottom of the opening 76. The operator 22 is pushed downwardly in the manner described above, causing the bolt 24 to move downwardly into the hole 90. Thus, the door section 74 is locked in the unfolded position.

Figure 16:
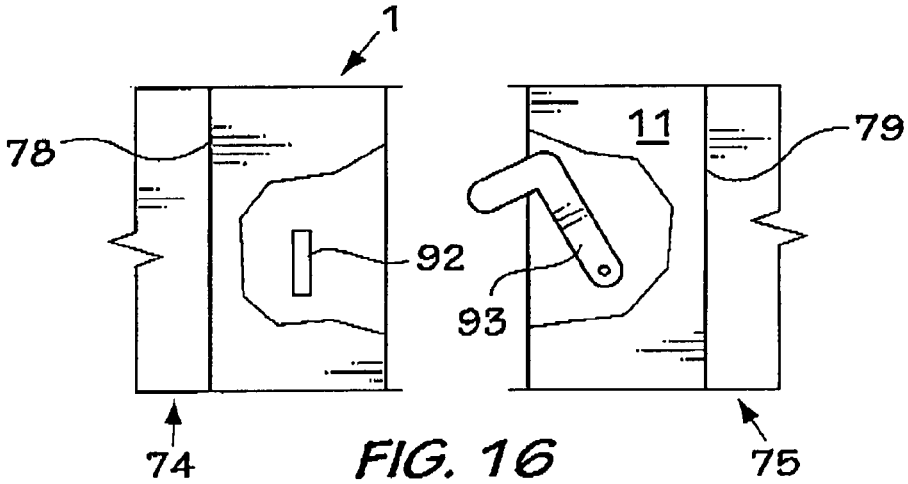
FIG. 16 is a partially cut away schematic side view of a lock for locking the free ends of the closure sections together.

The second door section 75 is then unfolded from the other side 83 of the building opening 76 and the leading end 10 of its post 11 is pushed into the female locking post 1 to cover the operator 22. The male locking post 11 is locked to the female post 1 using lock members 92 and 93 (FIG. 16) in the posts 1 and 11, respectively. The lock member 92 is defined by a plate similar to the stop plate 34. The plate is mounted on the partition 8 at about waist level. The lock member 93 is a pivot latch. Thus, the door sections 74 and 75 are locked together closing the opening 76. To unlock the door sections, the lock member 93 is released from the lock member 92, and the procedure described above when describing the operation of the operator is performed.

The invention claimed is:

1. A female locking post for a folding door or other closure comprising:

an elongated body of generally C-shaped cross section having an inner wall, a pair of side walls extending outwardly from said inner wall and an open outer end for receiving a male locking post;

a partition extending between the side walls at a location between said inner wall and the open outer end, the partition extending the length of the body;

a channel in the partition extending the length of the post, the channel opening outwardly toward said open outer end of the body;

an operator slidable longitudinally in said channel between a lower, locked position and an upper, unlocked position;

a bolt integral with and extending downwardly from said operator for insertion into a hole in a floor beneath the door or other closure when moved with the operator to the lower, locked position and for unlocking the door or closure when in the upper, unlocked position;

a spring on said bolt biasing the operator and bolt to the upper, unlocked position;

a lock mechanism for releasably retaining the operator in the lower, locked position; and a release for releasing the operator, permitting the spring to move the operator from the locked to the unlocked position.

2. The female locking post of claim 1 further comprising tracks extending longitudinally of said partition between the side walls of the post body and the channel; and wings extending laterally from said operator for sliding in said tracks during movement of the operator between the locked and unlocked positions.

3. The female locking post of claim 2, including a fixed bolt guide in a bottom end of said post body.

4. The female locking post of claim 3 including stop means on said partition above said operator for limiting upward movement of the operator.

5. The female locking post of claim 2, wherein said operator includes outwardly extending upper and lower ends, and an elongated recessed section between said upper and lower ends, said wings extending laterally from said upper and lower ends.

6. The female locking post of claim 5, wherein said lock mechanism includes a stop plate extending across the channel in the partition between the upper and lower ends of the operator; a cavity in an outer surface of said recessed section of said operator; and a spring-loaded lock bar movable between a release position in said cavity and an extended position for engaging a bottom end of said stop plate for preventing upward movement of the operator in the lower, locked position.

7. The female locking post of claim 6, wherein said release includes a cover fixedly mounted on said operator; and a flexible finger in said plate for bearing against said lock bar to push the lock bar into the cavity, permitting upward movement of the operator from the locked position to the unlocked position.

* * * * *